US007805087B2

(12) United States Patent
Sunada

(10) Patent No.: US 7,805,087 B2
(45) Date of Patent: Sep. 28, 2010

(54) IMAGE FORMING APPARATUS

(75) Inventor: Hidenori Sunada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 644 days.

(21) Appl. No.: 11/696,399

(22) Filed: Apr. 4, 2007

(65) Prior Publication Data

US 2007/0237530 A1 Oct. 11, 2007

(30) Foreign Application Priority Data

Apr. 6, 2006 (JP) ..... 2006-105230
Mar. 29, 2007 (JP) ..... 2007-087880

(51) Int. Cl.
*G03G 15/00* (2006.01)

(52) U.S. Cl. ..... 399/21; 399/18

(58) Field of Classification Search ..... 399/18, 399/21

See application file for complete search history.

(56) References Cited

U.S. PATENT DOCUMENTS 5,365,322 A * 11/1994 Hamada et al. ..... 399/21
5,809,391 A * 9/1998 Fujita et al. ..... 399/396
6,560,415 B2 * 5/2003 Hirako et al. ..... 399/18
6,744,993 B2 * 6/2004 Takami ..... 399/22
7,110,689 B2 * 9/2006 Takahashi ..... 399/68
7,391,980 B2 * 6/2008 Sekiguchi et al. ..... 399/20
7,480,466 B2 * 1/2009 Uchida ..... 399/21
2004/0247333 A1 * 12/2004 Takahashi ..... 399/68

FOREIGN PATENT DOCUMENTS

JP 7-140836 A 6/1995
JP 2003-323068 A 11/2003

* cited by examiner

*Primary Examiner*—Anthony H. Nguyen
(74) *Attorney, Agent, or Firm*—Canon U.S.A., Inc. I.P. Division

(57) ABSTRACT

An image forming apparatus includes a sheet conveying device configured to convey a sheet along a conveying path, a fixing roller configured to perform thermal fixing on the sheet having unfixed toner, a motor configured to rotationally drive the fixing roller, a first sheet detector disposed downstream from the fixing roller, a second sheet detector provided between the first sheet detector and the fixing roller and where the second sheet detector does not detect the sheet when the sheet is being properly conveyed, and a controller configured to perform motor stopping methods for stopping the driving of the motor, wherein the methods providing different motor stopping capabilities. When the first sheet detector is not detecting the sheet at a predetermined timing, the controller selects from the methods on the basis of a detection result of the second sheet detector.

9 Claims, 6 Drawing Sheets

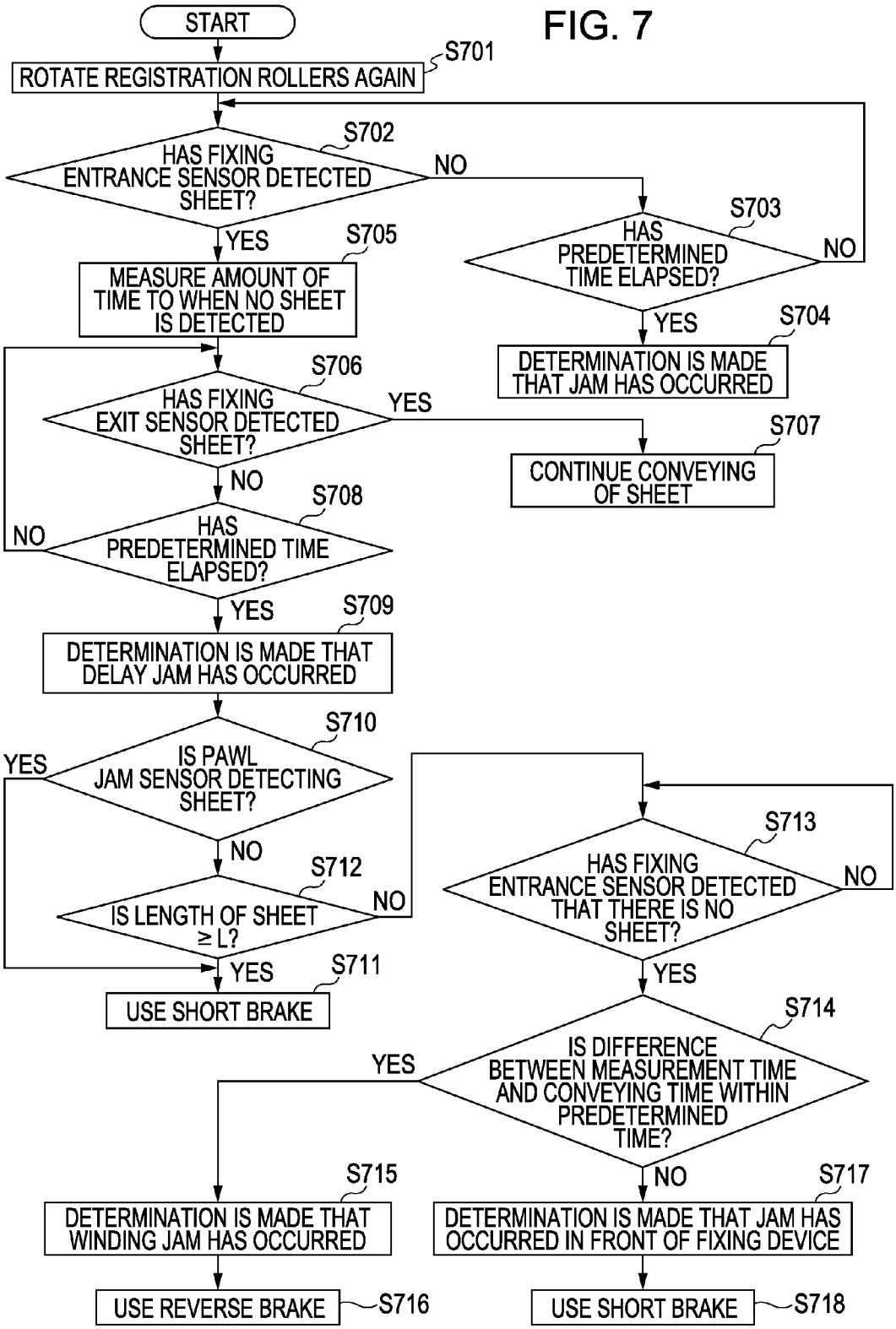
FIG. 7
START
ROTATE REGISTRATION ROLLERS AGAIN
S701
HAS FIXING ENTRANCE SENSOR DETECTED SHEET?
S702
NO
YES
HAS PREDETERMINED TIME ELAPSED?
S703
NO
YES
DETERMINATION IS MADE THAT JAM HAS OCCURRED
S704
MEASURE AMOUNT OF TIME TO WHEN NO SHEET IS DETECTED
S705
HAS FIXING EXIT SENSOR DETECTED SHEET?
S706
YES
CONTINUE CONVEYING OF SHEET
S707
NO
HAS PREDETERMINED TIME ELAPSED?
S708
NO
YES
DETERMINATION IS MADE THAT DELAY JAM HAS OCCURRED
S709
IS PAWL JAM SENSOR DETECTING SHEET?
S710
YES
NO
IS LENGTH OF SHEET ≥ L?
S712
NO
YES
USE SHORT BRAKE
S711
HAS FIXING ENTRANCE SENSOR DETECTED THAT THERE IS NO SHEET?
S713
NO
YES
IS DIFFERENCE BETWEEN MEASUREMENT TIME AND CONVEYING TIME WITHIN PREDETERMINED TIME?
S714
YES
NO
DETERMINATION IS MADE THAT WINDING JAM HAS OCCURRED
S715
DETERMINATION IS MADE THAT JAM HAS OCCURRED IN FRONT OF FIXING DEVICE
S717
USE REVERSE BRAKE
S716
USE SHORT BRAKE
S718

IMAGE FORMING APPARATUS

BACKGROUND OF THE INVENTION

1. Field of the Invention

The present invention relates to detection of a jam at a fixing device of an image forming apparatus.

2. Description of the Related Art

In an image forming apparatus, such as a copying machine or a printer, a sheet detecting sensor is provided at a sheet conveying path to determine whether or not a sheet jam has occurred from a detection result. A "winding jam" is one type of jam in which a front edge of a sheet that has passed a roller in a fixing device is not separated from the roller in the fixing device and, as a result, is wound upon the roller in the fixing device. When the sheet is completely wound upon the fixing device due to the winding jam, toner on the sheet causes the roller in the fixing device to adhere to the sheet. Accordingly, it takes a lot of time and trouble to separate the sheet from the roller. For instance, this may make it necessary for service personnel to disassemble and repair or replace the fixing device.

Therefore, there are proposed image forming apparatuses (such as those disclosed in Japanese Patent Laid-Open Nos. 7-140836 and 2003-323068) that are capable of stopping a fixing device when a sensor, disposed at an exit side of the fixing device, does not detect a sheet at a predetermined timing and it is, thus, determined that the sheet is wound upon a fixing roller. These image forming apparatuses make it possible for a user to properly perform operations as a result of stopping the apparatuses before the sheet is completely wound upon the fixing device.

In a high-speed copying machine, such as a copying machine that prints 100 pages of A4 size sheets every minute, even if driving of a fixing device is stopped when a winding jam occurs, the fixing device cannot be stopped immediately due to inertia of a fixing roller and a motor. Therefore, it is not possible to prevent a sheet, such as an A4 size sheet or an LTR size sheet, having a short length in a conveying direction from being completely wound upon the fixing roller.

Accordingly, apparatuses, such as those disclosed in US patents, having the following feature are provided. Such apparatuses make it possible to stop a fixing motor before even a small sheet is completely wound upon a fixing roller, as a result of suddenly braking the fixing motor by passing an electrical current that stops driving the fixing motor in a forward direction and that, at the same, rotates the fixing motor in a reverse direction when stopping the driving of the fixing motor.

However, in the above-described related image forming apparatuses, when sudden braking is performed whenever the driving of the fixing device is to be stopped, a large load is applied to the fixing motor each time the fixing motor is rotated and stopped. As a result, the life of the fixing motor is reduced, thereby reducing exchange cycles of the fixing device, and thus, increasing operational costs.

SUMMARY OF THE INVENTION

The present invention provides an image forming apparatus that can overcome the aforementioned problems.

The present invention also provides another image forming apparatus which is capable of stopping a fixing roller before a sheet is completely wound upon the fixing roller and which is capable of preventing the life of a motor from being reduced to the extent possible.

According to the present invention, an image forming apparatus includes a sheet conveying device configured to convey a sheet along a conveying path, a fixing roller configured to perform thermal fixing on the sheet having unfixed toner, a motor configured to rotationally drive the fixing roller, a first sheet detector disposed downstream from the fixing roller, a second sheet detector provided between the first sheet detector and the fixing roller and where the second sheet detector does not detect the sheet when the sheet is being properly conveyed, and a controller configured to perform a plurality of motor stopping methods for stopping the driving of the motor, wherein the plurality of motor stopping methods provide different motor stopping capabilities. In the image forming apparatus, when the first sheet detector is not detecting the sheet at a predetermined timing, the controller selects from the plurality of motor stopping methods on the basis of a detection result of the second sheet detector.

Further features of the present invention will become apparent from the claims and the following description of exemplary embodiments with reference to the attached drawings.

BRIEF DESCRIPTION OF THE DRAWINGS

FIG. 7 is a flowchart showing an example motor stopping controlling operation that is performed when it is determined that a jam has occurred in the second embodiment.

DESCRIPTION OF THE EMBODIMENTS

First Exemplary Embodiment

A first embodiment will be described using as an example a digital copying machine that is an image forming apparatus having a structure according to the present invention.

Figure 1:
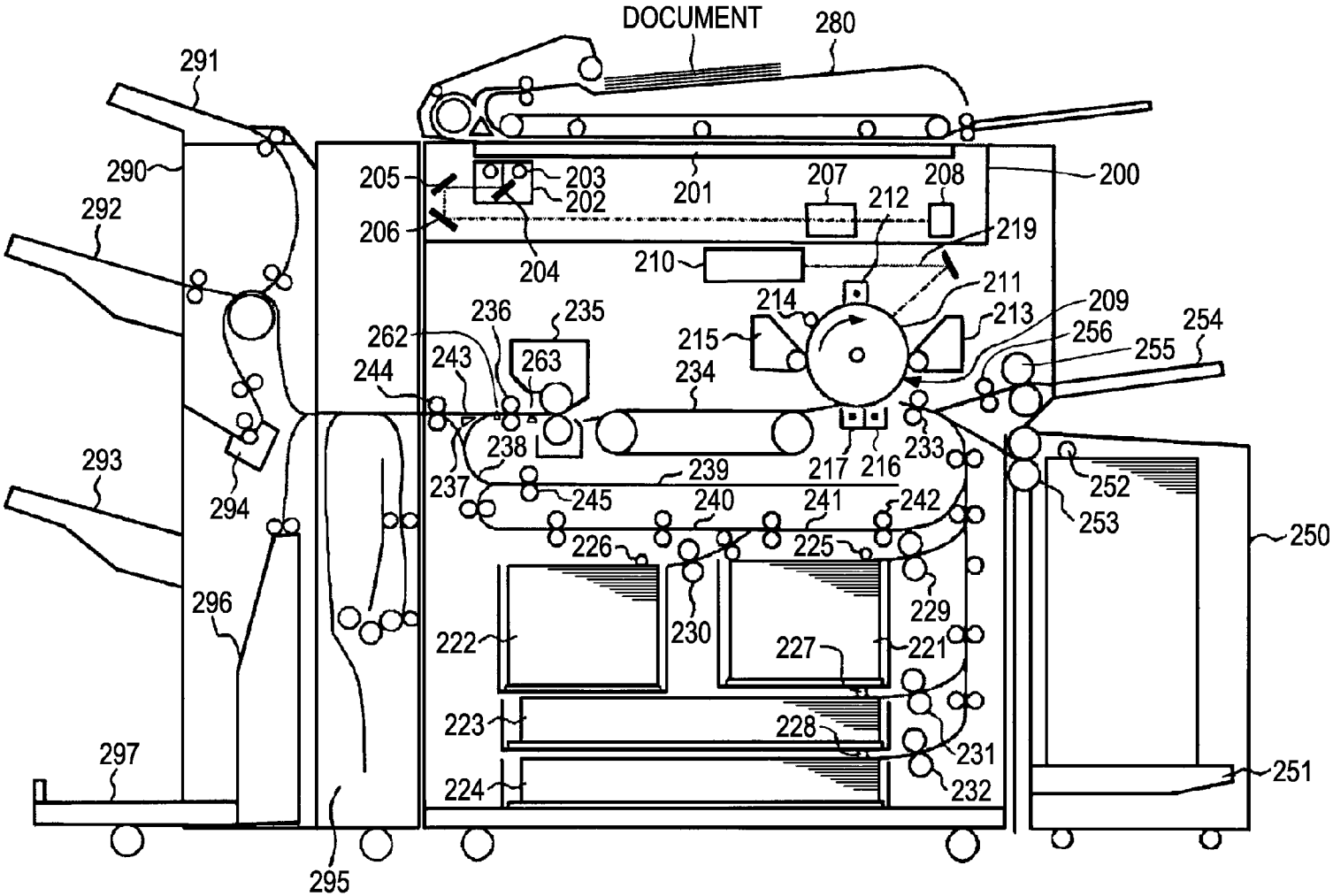
FIG. 1 is a digital copying machine according to a first embodiment of the present invention.

FIG. 1 is a sectional view of a structure of the digital copying machine according to the embodiment. In FIG. 1, reference numeral 100 denotes a digital copying machine body, and reference numeral 280 denotes an automatic document feeder (ADF). Reference numeral 201 denotes a platen glass serving as an original table, and reference numeral 202 denotes a scanner including, for example, an original illumination lamp 203 and a scanning mirror 204. While moving the scanner 202 by a motor (not shown) in a predetermined direction, reflected light of an original passes through a lens 207 through the scanning mirror 204 and scanning mirrors 205 and 206, and is focused onto a CCD sensor in an image sensor 208.

Reference numeral 209 denotes an image forming device including, for example, an exposure unit 210, a photosensitive drum 211, a primary charger 212, a developing unit 213, a pre exposure lamp 214, and a cleaning unit 215. The exposure unit 210 includes, for example, a laser scanner or a polygon scanner. The exposure unit 210 modulates laser light 219 and illuminates the photosensitive drum 211 with the laser light 219 on the basis of an image signal that is converted into an electrical signal at the image sensor 208 and that is subjected to a predetermined image processing operation. The primary charger 212, the developing unit 213, a transfer charger 216, the pre exposure lamp 214, and the cleaning unit 215 are disposed around the photosensitive drum 211. In the image forming device 209, the photosensitive drum 211 is rotated in the direction of the illustrated arrow by a motor (not shown). After the photosensitive drum 211 is charged to a predetermined electrical potential by the primary charger 212, the photosensitive drum 211 is illuminated with the laser light 219 from the exposure unit 210, thereby forming an electrostatic latent image on the photosensitive drum 211. The electrostatic latent image on the photosensitive drum 211 is developed by the developing unit 213, so that it is made visible as a toner image.

Sheets that are fed by a pickup roller 225, a pickup roller 226, a pickup roller 227, and a pickup roller 228 from a right cassette deck 221, a left cassette deck 222, an upper cassette 223, and a lower cassette 224, respectively, are fed to a conveying path by sheet-feed rollers 229, sheet-feed rollers 230, sheet-feed rollers 231, and sheet-feed rollers 232, respectively. Then, the sheets are sent to a transfer unit by registration rollers 233, so that the toner image on the photosensitive drum 211 is transferred onto the sheets by the transfer charger 216. After the transfer, residual toner on the photosensitive drum 211 is cleaned off by the cleaning unit 215, and residual electrical charge on the photosensitive drum 211 is removed by the pre exposure lamp 214.

After the transfer, the sheet on the photosensitive drum 211 is separated from the photosensitive drum 211 by a separating charger 217, and is conveyed to a fixing device 235 as it is by a conveying belt 234. The toner on the sheet conveyed to the fixing device 235 is fixed by applying pressure and heat, after which the sheet having the fixed toner image is discharged outside the digital copying apparatus body 100 by inner discharge rollers 236 and discharge rollers 244.

The digital copying machine body 100 includes a deck 250 that can accommodate 3500 sheets. A lifter 251 of the deck 250 is raised in accordance with the number of sheets so that a pickup roller 252 is always in contact with the sheet. The sheets are sent to the conveying path in the body by sheet-feed rollers 253.

The digital copying machine body 100 also includes a multi manual feed tray 254 that can hold 100 sheets. The sheets on the tray 254 are sent to the registration rollers 233 by sheet-feed rollers 255 and conveying rollers 256.

Reference numeral 237 denotes a discharge flapper for switching a sheet conveying destination to either a conveying path 238 side or a discharge path 243 side. Reference numeral 240 denotes a lower conveying path. The sheet from the inner discharge rollers 236 is reversed through a reversal path 239 and guided to a refeeding path 241 via the lower conveying path 240. The sheet fed from the left cassette deck 222 by the sheet-feed rollers 230 is also guided to the refeeding path 241. Reference numerals 242 denote refeeding rollers that refeed the sheet to the image forming device 209. Reference numerals 244 denote the discharge rollers that are disposed near the discharge flapper 237 and that discharge to the outside of the copying machine the sheet whose sheet conveying destination has been switched to the discharge path 243 side by the discharge flapper 237. When performing two-sided recording (two-sided copying), the discharge flapper 237 is raised, so that the sheet after the copying operation is guided to the refeeding path 241 through the reversal path 239 and the lower conveying path 240. At this time, the sheet is moved into the reversal path 239 up to the back edge of the sheet by reversal rollers 245, so that, by reversing the rotation of the reversal rollers 245, the sheet is sent to the lower conveying path 240. When the front and back of the sheet from the body 100 are reversed to discharge the sheet, the discharge flapper 237 is raised, so that the reversal rollers 245 pull the sheet into the reversal path 239 except a portion of the back edge of the sheet. Then, by reversing the rotation of the reversal rollers 245, the sheet is reversed and sent towards the discharge rollers 244.

A plurality of sensors for detecting the passage of the sheets are disposed at the sheet conveying path. A fixing exit sensor 262 is disposed at the exit of the fixing device 235. A pawl jam sensor 263 is disposed between the fixing exit sensor 262 and the fixing device 235. The pawl jam sensor 263 is provided at a location where it does not detect a sheet that is being properly conveyed. This location will be more specifically described below. The jam sensor 263 is capable of detecting a sheet that is curved into, for example, the shape of an accordion at the discharge side of the fixing device as a result of an abnormality occurring in the conveying of the sheet, such as the sheet being caught by a separation pawl that is provided at the discharge side of the fixing device 235.

Reference numeral 290 denotes a discharge processing device (finisher) that aligns and binds the sheets discharged from the digital copying machine body 100. The sheets that are discharged one sheet at a time are stacked and aligned at a processing tray 294. After the stacking and aligning of some of the sheets to which images have been formed are completed, the sheet bundle is stapled and discharged to either a sheet discharge tray 292 or a sheet discharge tray 293. The sheet discharge tray 293 is controlled so as to move upward and downward by a motor (not shown), and is moved to a location corresponding to the location of the processing tray 294 before starting image formation. Then, as the sheets that are discharged to the sheet discharge tray 293 are stacked, the height of a sheet plane is moved so as to be slightly lower than the position of a discharge portion of the processing tray 294. Reference numeral 291 denotes a sheet tray upon which separation sheets that are inserted between the discharged sheets are stacked. Reference numeral 295 denotes a Z folding device that folds the discharged sheets into the shape of the letter Z. Reference numeral 296 denotes a binding device that binds the discharged sheets by stapling the central portions, as viewed from the conveying direction, of the discharged sheets and folding them in half. The bound sheet bundle is discharged onto a sheet discharge tray 297.

Figure 2:
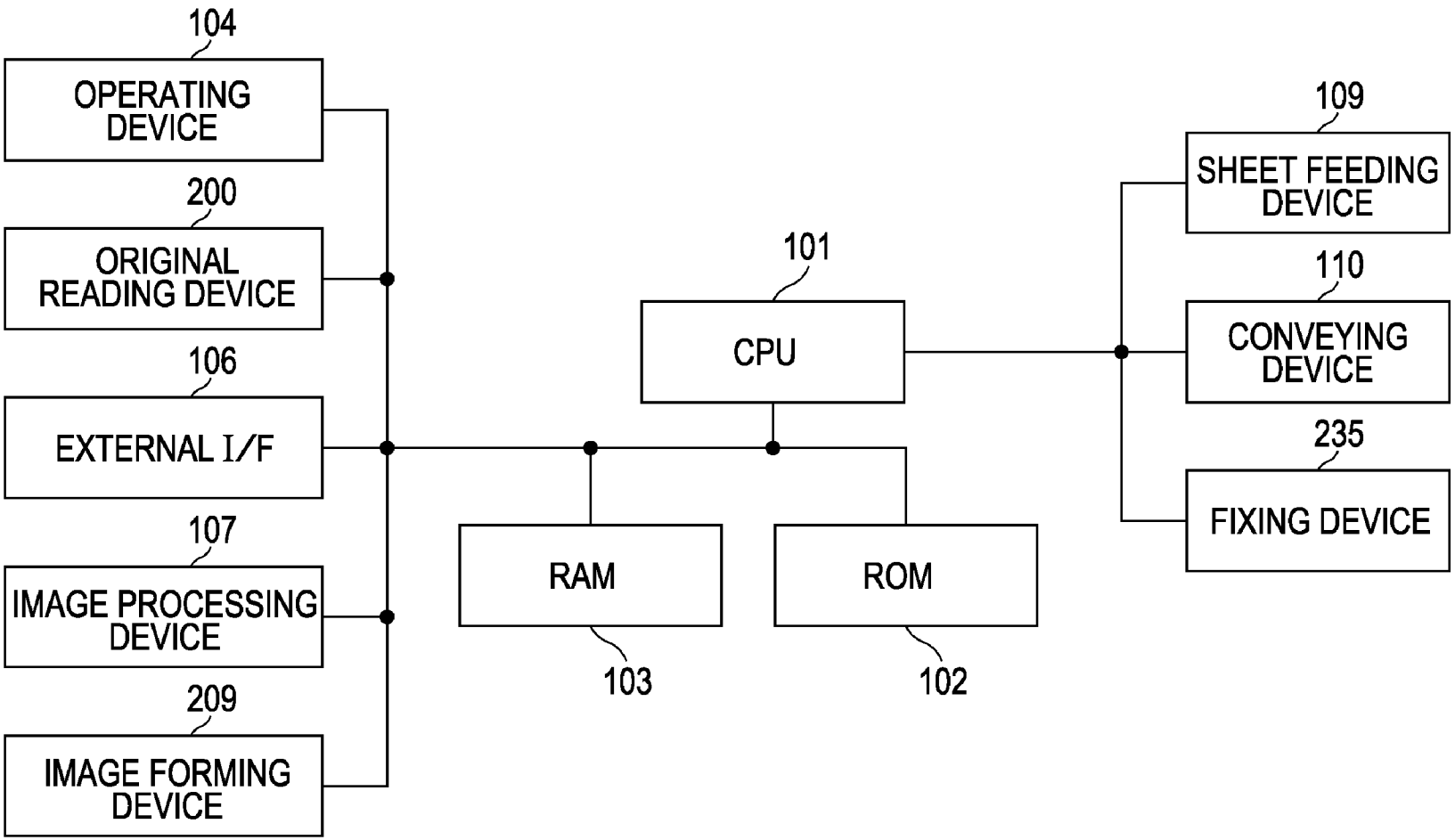
FIG. 2 is a block diagram schematically showing an example structure of the digital copying machine according to the first embodiment.

FIG. 2 is a block diagram schematically showing the structure of the digital copying machine shown in FIG. 1.

Reference numeral 101 denotes a central processing unit (CPU) that controls the entire digital copying machine. Reference numeral 102 denotes read-only memory (ROM) that stores a control program to be executed by the CPU 101. Reference numeral 103 denotes random-access memory (RAM) that is used as a required working area for controlling the digital copying machine. RAM 103 stores, for example, image data obtained by reading an original by a reading device 200, image data that is sent from outside the copying machine through an external I/F 106, and a control signal. RAM 103 is also used as a working area for performing, using an image processing device 107, an image processing operation on the image data obtained from the reading device 200 or the external I/F 106. Reference numeral 104 denotes an operating device for performing various setting operations and displaying various items of data.

Reference numeral 106 denotes the external I/F that is connected to a network such as Transmission Control Protocol/Internet Protocol (TCP/IP). The external I/F 106 can receive an instruction for executing a print job from a computer connected to the network, and give information regarding the interior of the digital copying machine to the computer. The image processing device 107 performs a required image processing operation on the image data. The image data that has been subjected to the image processing is stored in RAM 103.

A sheet-feeding device 109 corresponds to the right cassette deck 221, the left cassette deck 222, the upper cassette 223, the lower cassette 224, the deck 250, the multi manual feed tray 254, and the sheet-feeding mechanisms thereof (all of which are shown in FIG. 1). A conveying device 110 corresponds to the conveying mechanisms, such as the registration rollers 233, the conveying belt 234, and the discharge rollers 236 (all of which are shown in FIG. 1).

Figure 3:
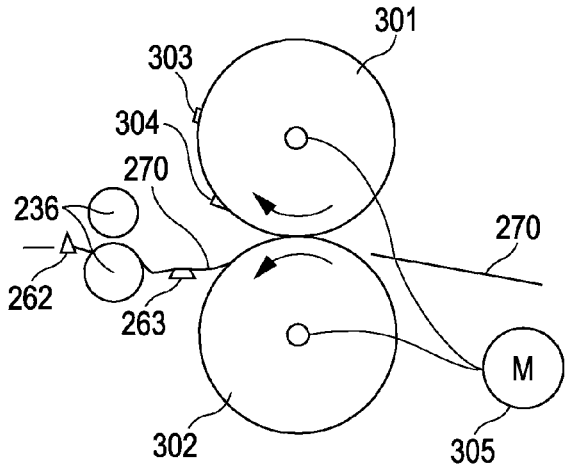
FIG. 3 is a schematic view showing an example structure of a fixing device and the vicinity thereof according to the first embodiment.

FIG. 3 is a schematic view showing an example structure of the fixing device and the vicinity thereof. The fixing device 235 includes a fixing roller 301, a pressure roller 302, a temperature sensor 303, and a separation pawl 304. The fixing roller 301 includes a heat source therein. The pressure roller 302 rotates while it is in press-contact with the fixing roller 301. The temperature sensor 303 detects the surface temperature of the fixing roller 301. The fixing exit sensor 262 is disposed downstream from the fixing device 235. The pawl jam sensor 263 is disposed between the fixing exit sensor 262 and the fixing device 235. The pawl jam sensor 263 is provided at a location where it does not detect a sheet that is discharged from the fixing device 235 when this sheet is being properly conveyed.

More specifically, the pawl jam sensor 263 is provided at a location that is separated from an imaginary straight line (conveying path) that connects a nip between the fixing roller 301 and the pressure roller 302 and a nip between the pair of inner discharge rollers 236. The inner discharge rollers 236 convey downstream the sheet discharged from the fixing device 235. The fixing exit sensor 262 may be disposed upstream from the inner discharge rollers 236. Reference numeral 270 denotes a sheet conveying guide. The temperature sensor 303 detects the surface temperature of the fixing roller 301. The heat source (not shown) in the fixing roller 301 is controlled using an output from the temperature sensor 303 so that the surface temperature of the fixing roller 301 becomes a temperature required for fixing toner on a sheet. By passing the sheet through the nip between the fixing roller 301 and the pressure roller 302, the toner on the surface of the sheet is fixed thereto by heat and pressure. However, depending upon the moisture content of the sheet, the amount of toner on the surface of the sheet, and the position of the toner, the sheet may not be properly separated from the fixing roller 301, that is, the sheet may remain adhered to the fixing roller 301, even after the sheet has passed the nip.

Accordingly, the separation pawl 304 is kept in contact with the fixing roller 301, so that the sheet that is adhered to the fixing roller 301 is physically separated from the fixing roller 301. Further, a fixing motor 305 for rotationally driving the fixing roller 301 and the pressure roller 302 is provided. The fixing motor 305 is provided with two types of brakes for stopping the rotation thereof.

One of the brakes is a reverse brake (reverse rotation brake) that emergency stops the fixing roller 301 that is rotating in the direction of the arrow shown in FIG. 3, as a result of deliberately passing electrical current that rotates the fixing motor in a reverse direction. The reverse brake has a larger deceleration effect on the fixing motor 305, but exerts a large load on the fixing motor 305. Therefore, when it is regularly used, the life of the fixing motor 305 is reduced.

The other brake is a short brake (short-circuit brake) that short-circuits a circuit in which driving current of the fixing motor 305 flows in the motor, to brake the motor 305 by electromotive force that is generated by the motor 305 that continues rotating by inertia even after the driving current is turned off. Although the short-circuit brake has a smaller deceleration effect than the reverse brake, it applies less load on the fixing motor 305, so that it has little influence on the life of the fixing motor 305.

Another method of stopping the motor is to naturally stop the motor 305 by simply turning off the electrical current flowing through the fixing motor 305. Accordingly, this method does not use any attenuating mechanism for the fixing motor 305.

An aspect of the embodiment that includes selecting the method of braking the fixing motor when it is determined that a sheet is jammed on the basis of an output of the fixing exit sensor will now herein be described.

The aforementioned aspect will first be described for a case in which the CPU 101 determines that a jam has occurred on the basis of a detection output from the fixing exit sensor 262. The sheet fed from any of the sheet-feed rollers 229, 230, 231, and 232 is sent to the sheet conveying path and is stopped once as a result of striking the registration rollers 233. The sheet waits as it is, and the registration rollers 233 rotate again when a timing at which the front end of a toner image on the photosensitive drum 211 is aligned with the front edge of the sheet at the transfer charger 216 is reached.

The distance from the registration rollers 233 to the fixing exit sensor 262 is constant and a sheet conveying speed between them is also constant. Therefore, an ideal arrival time from when the registration rollers 233 are rotated to when the sheet is detected by the fixing exit sensor 262 is easily determined. However, actually, the sheet that has passed a path between the photosensitive drum 211 and the transfer charger 216 may be pulled towards the photosensitive drum 211 due to the influence of the charging of the sheet and the toner. Therefore, a slight conveyance loss occurs. Consequently, a time margin for determining a jam needs to be provided from the beginning in accordance with the conveyance loss. The CPU 101 continues waiting for a predetermined amount of time (=the ideal arrival time+jam margin) from when the registration rollers 233 start rotating again to when the fixing exit sensor 26 detects the presence of the sheet. When the presence of the sheet is not detected even if the CPU 101 waits for the predetermined amount of time, the CPU 101 determines that a jam has occurred. For example, when the distance from the registration rollers 233 to the fixing exit sensor 262 is 400 mm, a sheet conveying speed therebetween is 500 mm/sec, and the jam margin of a delay in conveyance at the fixing exit sensor 262 is 0.08 sec, a maximum arrival time from the registration rollers 233 to the fixing exit sensor 262 is 400/500+0.08=0.88 sec. When the fixing exit sensor 262 does not detect the presence of the sheet when a jam timer, which is started when the registration rollers 233 rotate again, measures 0.88 sec, the CPU 101 determines that a delay jam has occurred with reference to the fixing exit sensor 262.

Figure 4:
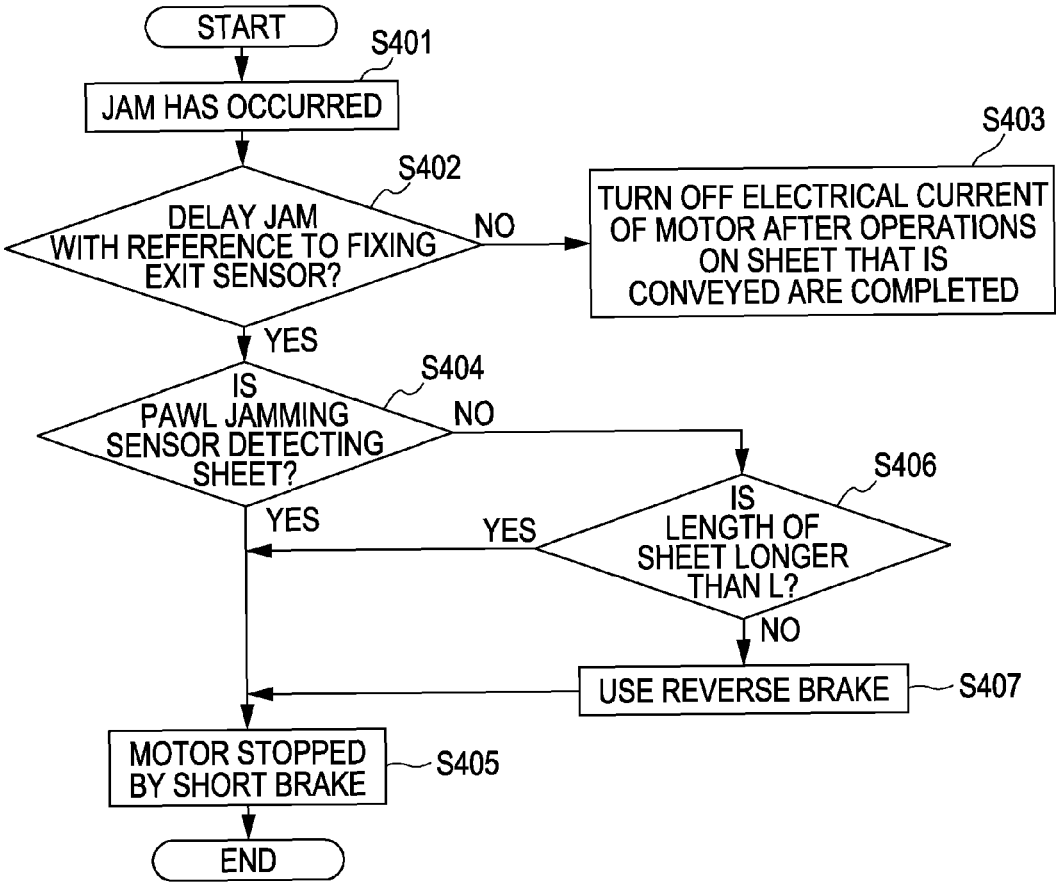
FIG. 4 is a flowchart showing an example motor stopping controlling operation that is performed when it is determined that a jam has occurred in the first embodiment.

Steps that are performed after the CPU 101 determines that a delay jam has occurred with reference to the fixing exit sensor 262 will be described with reference to the flowchart of FIG. 4. The steps in the flowchart are performed by the CPU 101.

When a jam has occurred in Step S401, and when the jam is not a delay jam that occurs with reference to the fixing exit sensor 262 in Step S402, it is not necessary to immediately stop the fixing motor 305. Therefore, in this case, the CPU 101 does not immediately stop the fixing motor 305. Instead, in Step S403, it turns off the driving current of the motor 305 when all of the operations on the sheet that is conveyed in the copying machine are completed. Then, it waits for the motor 305 to stop naturally.

In contrast, if the jam is a delay jam in Step S402, the CPU 101 confirms whether the pawl jam sensor 263 is detecting the sheet in Step S404. If the sheet is adhered to the fixing roller 301, the sheet is caught by the separation pawl 304, or the sheet that is separated from the fixing roller 301 is not properly conveyed by the inner discharge rollers 236, then the sheet is folded in a very narrow space defined by the fixing roller 301, the pressure roller 302, and the inner discharge rollers 236. When the folded sheet pushes the pawl jam sensor 263, the presence of the sheet is detected. Accordingly, when the pawl jam sensor 263 has detected the sheet in Step S404, the fixing motor 305 does not need to be immediately stopped because the sheet is not wound upon the fixing roller 301. However, if the separation pawl 304 by which the sheet is caught is left as it is, the pawl may be caught by the fixing roller 304 and scratch the roller 301. Therefore, the CPU 101 stops the fixing motor 305 with the short-circuit brake in Step S405.

When the pawl jam sensor 263 has not detected the presence of the sheet in Step S404, the CPU 101 determines that the sheet could not be separated from the fixing roller 301 by the separation pawl 304. In this case, since the sheet is wound upon the fixing roller 301, the fixing motor 305 must be stopped immediately.

However, if the back edge of the sheet is not wound upon the fixing roller 301 even if the sheet is wound upon the fixing roller 301 by a certain amount, a user can separate the sheet from the fixing roller 301 by manually reversing the rotation of the fixing roller 301 while pinching and pulling out the back edge of the sheet. In contrast, if the sheet is completely wound upon the fixing roller 301 as a result of the sheet having a short conveyance direction length like, for example, an A4 size sheet or a letter size sheet, it is very difficult for the user to separate the sheet from the fixing roller 301 considering that the fixing roller 301 is sufficiently heated.

Here, a distance through which the sheet is conveyed from when the sheet reaches the nip to when the CPU 101 determines that a jam has occurred is Ld, and a distance through which the sheet is conveyed from when the short-circuit brake is applied to when the fixing roller is stopped is Ls. In addition, a minimum length of the back edge of the sheet that is not wound upon the fixing roller 301, which is required for pulling out the jammed sheet from the fixing roller 301, is Lr. In this case, a sheet length L, which serves as a reference for selecting the reverse brake, is L=Ld+Ls+Lr.

If a previously determined length of the sheet that is jammed is longer than L in Step S406, the CPU 101 stops the fixing motor 305 with the short-circuit brake in Step S405. In contrast, if the length of the jammed sheet is less than or equal to L in Step S406, the CPU 101 stops the motor 305 using the reverse brake in Step S407.

Figure 5:
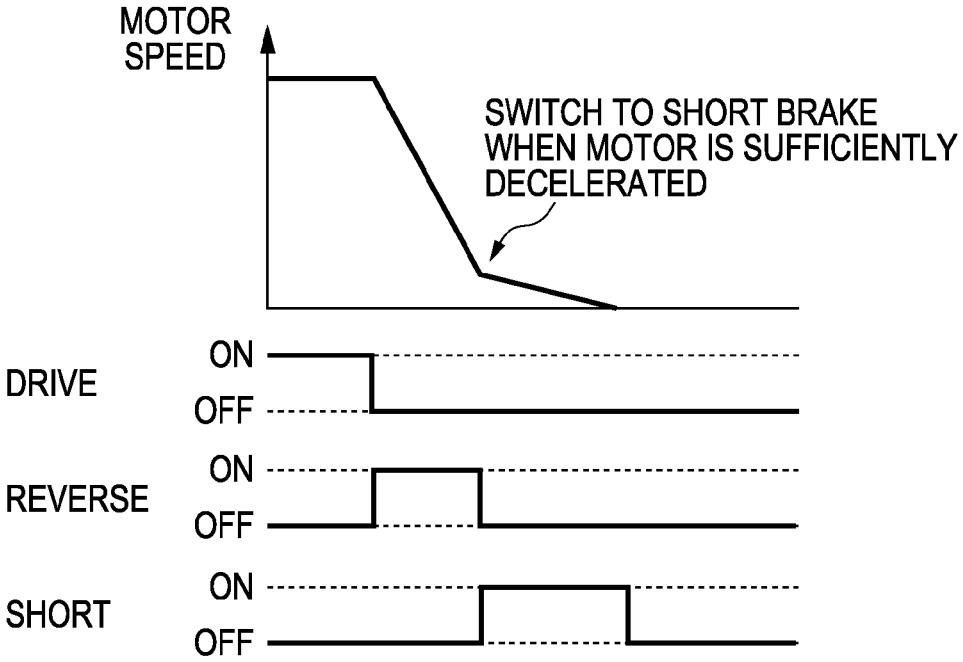
FIG. 5 shows an example simple sequence when a reverse brake is used.

Next, a method of using the reverse brake when stopping the motor 305 will be simply described with reference to FIG. 5. When the application of the reverse brake is continued, the fixing motor 305 not only stops but also starts rotating in the opposite direction. Therefore, instead of continuing the application of the reverse brake until the fixing motor 305 stops, it is applied only for an amount of time required to sufficiently decelerate the fixing motor 305, after which the fixing motor 305 is stopped by the short-circuit brake.

In the embodiment, the reverse brake is used when the CPU 101 determines that a delay jam has occurred as a result of the fixing exit sensor 262 not detecting the sheet at a predetermined timing, when the pawl jam sensor 263 does not detect the sheet, and when the length of the sheet is shorter than the predetermined length L. This makes it possible to reduce the frequency with which the reverse brake is used, so that it is possible to prevent a reduction in the life of the driving motor of the fixing device while preventing the sheet from being wound upon the fixing roller.

Second Exemplary Embodiment

A second embodiment according to the present invention will be described. A sectional view and functional structure of a digital copying machine according to the second embodiment are similar to those of the first embodiment. The second embodiment only differs from the first embodiment in the structure of the vicinity of a fixing device. Therefore, only the vicinity of the fixing device will be described.

Figure 6:
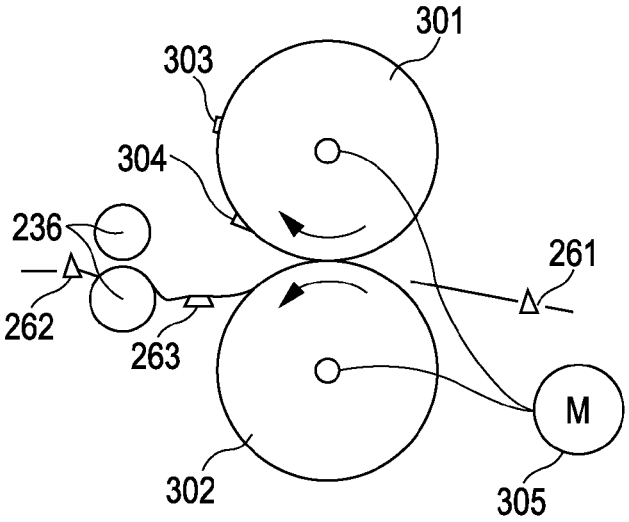
FIG. 6 is a schematic view of an example structure of a fixing device and the vicinity thereof according to a second embodiment.

FIG. 6 is a schematic view of the structure of the fixing device and the vicinity thereof of the digital copying machine according to the second embodiment. It differs from the first embodiment in that a fixing entrance sensor 261 is also provided upstream from the fixing device. This makes it possible to determine that a delay jam has occurred with reference to a fixing exit sensor 262 from the fixing entrance sensor 261 instead of from registration rollers 233. The addition of the fixing entrance sensor 261 makes it unnecessary to consider a sheet conveyance loss immediately after the sheet passes a photosensitive drum 211. As a result, it is possible to reduce a jam margin. Here, the sheet conveyance loss immediately after the sheet passes the photosensitive drum 211 is included in a jam margin from the registration rollers 233 to the fixing entrance sensor 261.

Steps that are carried out after it is determined that a delay jam has occurred with reference to the fixing exit sensor 262 in the structure including the fixing entrance sensor 261 will be described with reference to the flowchart shown in FIG. 7. The steps of the flowchart in FIG. 7 are carried out by the CPU 101.

In Step S701, the CPU 101 rotates the registration rollers 233 again to convey the sheet that is waiting in front of the registration rollers 233 and to pass the sheet between the photosensitive drum 211 and a transfer charger 216. Then, in Step S702, the CPU 101 determines whether or not the fixing entrance sensor 261 has detected the sheet. If the fixing entrance sensor 261 has not detected the sheet even if the CPU 101 has waited for a predetermined amount of time in Step S703, the CPU 101 determines that a delay jam has occurred with reference to the fixing entrance sensor 261 in Step S704. If in Step S703 the predetermined time has not elapsed, the process returns to Step S702.

If the fixing entrance sensor 261 has detected the sheet, in Step S705, the CPU 101 measures an amount of time from when the presence of the sheet is detected by the fixing entrance sensor 261 to when the fixing entrance sensor 261 does not detect the sheet. Then, the CPU 101 determines that the sheet has passed between a fixing roller 301 and a pressure roller 302, and waits for the sheet to be detected by the fixing exit sensor 262 in Step S706. If the fixing exit sensor 262 has detected the sheet, the sheet is being properly conveyed, so that the CPU 101 continues conveying the sheet (see Step S707).

Figure 8:
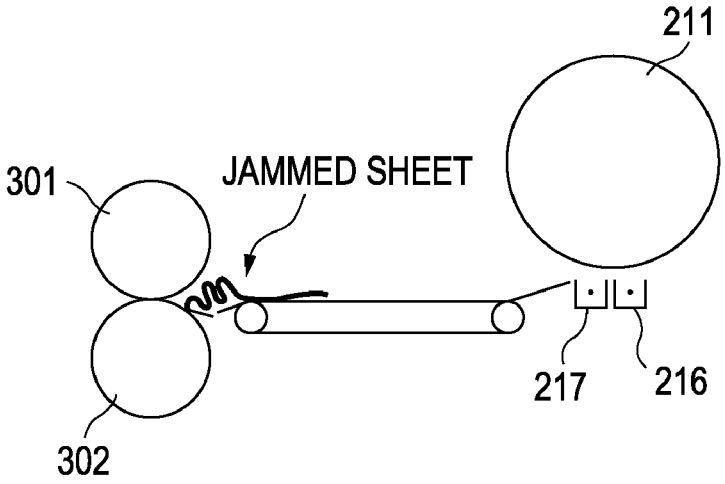
FIG. 8 is a reference diagram related to a sheet jam occurring between a photosensitive drum and the fixing device.

If the fixing exit sensor 262 has not detected the sheet even after the passage of a predetermined time in Step S708, the CPU 101 determines that a delay jam has occurred with reference to the fixing exit sensor in Step S709. Here, in Step S710, the CPU 101 determines whether or not a pawl jam sensor 263 is detecting the sheet. If, in Step S710, the pawl jam sensor 263 is detecting the sheet, the CPU 101 stops the fixing motor 305 by applying a short-circuit brake to the fixing motor 305 in Step S711. In contrast, if the pawl jam sensor 263 is not detecting the sheet in Step S710, the sheet may be in the following state instead of being wound upon the fixing roller 301. That is, the sheet that has passed between the photosensitive drum 211 and the transfer charger 216 flutters considerably towards the photosensitive drum 211, as a result of which the sheet cannot pass between the fixing roller 301 and the pressure roller 302. Therefore, the sheet is in an undulating state in a large space between the photosensitive drum 211 and the fixing device as shown in FIG. 8.

If the length of the sheet is equal to or greater than the predetermined length L in Step S712, the CPU 101 stops the fixing motor 305 by applying the short-circuit brake in Step S711. In contrast, if the length of the sheet is less than the predetermined length L, in Step S713, the CPU 101 further waits for a timing at which the fixing entrance sensor 261 does not detect the sheet.

Figure 9:
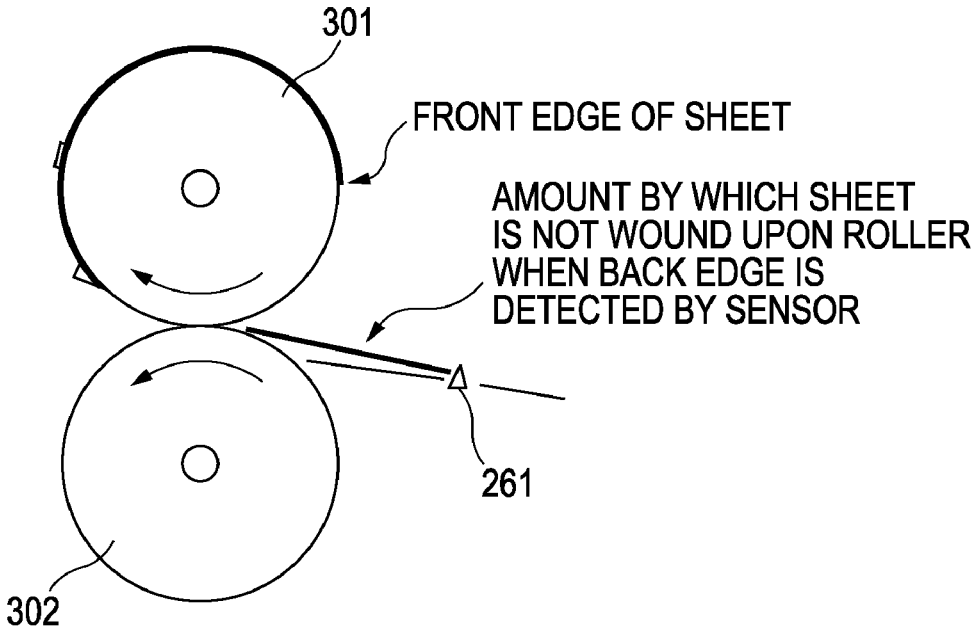
FIG. 9 is a reference diagram related to a jammed sheet that is wound upon the fixing device.

If the fixing entrance sensor 261 does not detect the sheet, the measurement in Step S705 is ended. If, in Step S714, the difference between the measurement time and a conveyance time for conveying the sheet through a distance corresponding to the length of the sheet is within a predetermined time (such as a conveyance time for conveying the sheet through a distance of 10 mm), the CPU 101 carries out the following controlling operation. Here, if the CPU 101 determines that the sheet is wound upon the fixing roller 301 in Step S715, the CPU 101 causes a reverse brake to be applied until the fixing motor 305 is sufficiently decelerated and, then, causes switching to the short-circuit brake in Step S716. Here, as shown in FIG. 9, the length of the back edge side of the sheet that is not wound upon the fixing roller 301 is equal to the distance between the fixing entrance sensor 261 and the fixing roller 301. Therefore, the application of the reverse brake is controlled so that the entire back edge of the sheet that is not wound upon the fixing roller 301 is not wound upon the fixing roller 301.

If the difference between the measurement time and the conveyance time is greater than the predetermined time in Step S714, the CPU 101 carries out the following controlling operation. Here, the sheet cannot pass between the fixing roller 301 and the pressure roller 302 and flutters. As a result, it is highly probable that the fixing entrance sensor 261 did not detect the sheet due to the raising of the sheet. Accordingly, the CPU 101 determines that a jam has occurred in front of the fixing device 235 in Step S717, and, at this time, applies the short-circuit brake in Step S718. The determination in Step S714 may be performed on the basis of distance instead of time.

In the embodiment, the reverse brake is used only when the fixing exit sensor 261 does not detect the sheet and the CPU 101 determines that a delay jam has occurred and when the pawl jam sensor 263 does not detect the sheet and the length of the sheet measured at the fixing entrance sensor 261 is within an error range of a previously determined length. Accordingly, it is possible to prevent the life of the motor that drives the fixing device from being reduced while properly preventing the sheet from becoming wound upon the fixing roller.

If the length of the sheet is less than the predetermined length L in Step S712, the reverse brake may be immediately applied. In this case, if the CPU 101 determines that a jam has not occurred in front of the fixing device in Step S717, the CPU 101 immediately stops using the reverse brake and switches to the use of the short-circuit brake. This reduces the amount of time that the reverse brake is used, thereby preventing the life of the motor 305 from being reduced.

If the length of the sheet is not greater than the predetermined length L in Step S712, the short-circuit brake may be immediately applied. In this case, if the CPU 101 determines that a jam has occurred in front of the fixing device in Step S717, the CPU 101 immediately stops using the short-circuit brake and switches to the use of the reverse brake. Accordingly, depending upon the length of the sheet, the deceleration of the motor 305 by the short-circuit brake is started before the fixing entrance sensor 261 no longer detects the sheet. Therefore, it is possible to reduce the amount by which the sheet is wound upon the fixing roller. In addition, since the speed of the motor 305 is slightly reduced when the reverse brake is applied, it is possible to reduce the load on the motor and to, thus, prevent the life of the motor 305 from being reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-105230 filed Apr. 6, 2006, and No. 2007-087880 filed Mar. 29, 2007, which are hereby incorporated by reference herein in their entirety.

What is claimed:

1. An image forming apparatus comprising:

a sheet conveying device configured to convey a sheet along a conveying path;

a fixing roller configured to perform thermal fixing on the sheet having unfixed toner;

a motor configured to rotationally drive the fixing roller;

a first sheet detector disposed downstream from the fixing roller;

a second sheet detector provided between the first sheet detector and the fixing roller and where the second sheet detector does not detect the sheet when the sheet is being properly conveyed; and a controller configured to perform a first motor stopping method and a second motor stopping method for stopping the driving of the motor, a deceleration force to decelerate the motor in the first motor stopping method is higher than a deceleration force to decelerate the motor in the second motor stopping method, wherein, when the controller detects that the sheet is jammed on the basis of the first sheet detector not detecting the sheet at a predetermined timing, the controller determines a motor stopping method to select on the basis of a detection result of the second sheet detector.

2. The image forming apparatus according to claim 1, wherein when the first sheet detector is not detecting the sheet at the predetermined timing and when the second sheet detector is not detecting the sheet, the controller stops the motor by the first motor stopping method.

3. The image forming apparatus according to claim 2, wherein when the first sheet detector is not detecting the sheet at the predetermined timing and when the second sheet detector is detecting the sheet, the controller stops the motor by the second motor stopping method.

4. The image forming apparatus according to claim 2, wherein when the second sheet detector is not detecting the sheet and when a length of the sheet is longer than a predetermined length, the controller stops the motor by the second motor stopping method.

5. The image forming apparatus according to claim 4, wherein, when the second sheet detector is not detecting the sheet and when the length of the sheet is equal to or less than the predetermined length, the controller stops the motor by the first motor stopping method.

6. The image forming apparatus according to claim 2, wherein the first motor stopping method uses a reverse brake that causes driving current that rotates the motor in a reverse direction to flow.

7. The image forming apparatus according to claim 3, wherein the second motor stopping method uses a short-circuit brake that short-circuits a circuit in which driving current of the motor flows.

8. The image forming apparatus according to claim 2, further comprising a third sheet detector which is disposed upstream from the fixing roller and which detects the sheet, wherein, when the controller is to stop the motor due to the first sheet detector not detecting the sheet at the predetermined timing and the second sheet detector not detecting the sheet, if a difference between a time from when the third sheet detector detects the sheet once to when the third sheet detector no longer detects the sheet and a conveying time for conveying the sheet through a distance corresponding to a length of the sheet is equal to or greater than a certain time, the controller stops the motor by the second motor stopping method.

9. The image forming apparatus according to claim 2, further comprising a third sheet detector which is disposed upstream from the fixing roller and which detects the sheet, wherein, when the controller is to stop the motor due to the first sheet detector not detecting the sheet at the predetermined timing and the second sheet detector not detecting the sheet, the controller stops the motor by the first motor stopping method in response to the third sheet detector detecting a back edge of the sheet.

* * * * *